US006189253B1

(12) United States Patent
Knight et al.

(10) Patent No.: US 6,189,253 B1
(45) **Date of Patent: *Feb. 20, 2001**

(54) MUZZLELOADING RIFLE AND METHOD AND MEANS FOR LOADING THE SAME

(75) Inventors: William A. Knight; L. Dale Watley, both of Centerville, IA (US)

(73) Assignee: Ebsco Industries, Inc., Birmingham, AL (US)

( * ) Notice: Under 35 U.S.C. 154(b), the term of this patent shall be extended for 0 days.

This patent is subject to a terminal disclaimer.

(21) Appl. No.: 09/250,798

(22) Filed: Feb. 17, 1999

Related U.S. Application Data

(63) Continuation of application No. 08/971,858, filed on Nov. 17, 1997, now Pat. No. 5,915,931, which is a continuation of application No. 29/068,298, filed on Mar. 27, 1997, now abandoned, which is a continuation-in-part of application No. 29/061,045, filed on Oct. 16, 1996, now abandoned.

(60) Provisional application No. 60/031,300, filed on Nov. 18, 1996.

(51) Int. Cl.[7] ..... F41C 7/00

(52) U.S. Cl. ..... 42/51; 42/16

(58) Field of Search ..... 42/51, 16

(56) References Cited

U.S. PATENT DOCUMENTS

| | | | |
|---|---|---|---|
| 4,227,330 | 10/1980 | Chapin | 42/77 |
| 4,700,499 | 10/1987 | Knight | 42/51 |
| 5,307,583 | 5/1994 | Mahn et al. | 42/51 |
| 5,408,776 | 4/1995 | Mahn et al. | 42/51 |
| 5,487,232 | 1/1996 | Osborne et al. | 42/51 |
| 5,606,817 | 3/1997 | Sachse | 42/51 |
| 5,718,073 | 2/1998 | Sachse et al. | 42/51 |

*Primary Examiner*—Charles T. Jordan
*Assistant Examiner*—Denise J Buckley
(74) *Attorney, Agent, or Firm*—Zarley, McKee, Thomte, Voorhees & Sease

(57) ABSTRACT

A muzzleloading rifle has a bolt with a laterally extending handle. The bolt is operationally connected to the cocking piece of the firearm by means of engaged cam surfaces of the bolt and the cocking piece which will permit the rifle to be cocked only by moving the bolt handle in an upwardly and rotational motion without any longitudinal movement of the bolt towards the cocking piece. After the firearm has been loaded by means of depositing a disc element with a primer element in the center bore thereof in the breech opening of the firearm, the firearm is placed in a firing condition by reversing rotational motion of the bolt handle. The disc element has a center bore which is adapted to receive a conventional nipple and a percussion cap, or in lieu thereof, and preferably, a shot gun primer. The latter is preferred in that it provides a hotter and more intense ignition of the gun powder in the muzzleloading rifle art. The hotter and speed of ignition of the shotgun primer improves the fire power, velocity, and accuracy of the muzzleloading rifle. A method of loading a muzzleloading rifle involves the steps of cocking the firearm and loading the firearm with the disc elements as described heretofore.

20 Claims, 9 Drawing Sheets

1A-1A
10
12
14
16
16A
18
20
22
108
2
4
21

120
140
108
106
122
124
5
5
104

121
121
124
124
126
132
134
134
134
134
136
136
136
136
138

MUZZLELOADING RIFLE AND METHOD AND MEANS FOR LOADING THE SAME

CROSS REFERENCE TO A RELATED APPLICATION

This application is a continuation of applicant's application Ser. No. 08/971,858 filed Nov. 17, 1997 now U.S. Pat. No. 5,915,931 which is based upon the Applicant's Provisional application Ser. No. 60/031,300 filed Nov. 18, 1996 and which is a continuation of Design patent application Ser. No. 29/068,298 filed Mar. 27, 1997, now abandoned which is a Continuation-In-Part of Design patent application Ser. No. 29/061,045 filed Oct. 16, 1996 (now abandoned).

BACKGROUND OF THE INVENTION

Modern muzzleloading rifles are primarily of the in-line type which do not utilize the cocking and loading operations of the structure of a conventional bolt-action rifle. The purpose of this invention is to adapt the bolt-action phenomenon in a simplified form to the muzzleloading rifle art. A further object of this invention is to simplify the conventional bolt-action rifle functions to only upwardly and downwardly movement of the bolt handle rather than an upwardly and rearwardly and thence forwardly and downwardly action of a typical bolt-action rifle.

A further object of this invention is to provide a small disc into which a primer is mounted in a center bore thereof for insertion into the breech opening of the firearm to facilitate the loading of the rifle and the reloading thereof.

A still further object of the invention is to provide a muzzleloading rifle and method and means for loading the same which is extremely safe in use and operation.

A still further object of the invention is to provide a visible indicator that will permit the user to visually determine that the rifle is loaded.

These and other objects will be apparent to those skilled in the art.

SUMMARY OF THE INVENTION

The firearm of this invention utilizes a bolt with a laterally extending handle. The bolt is operationally connected to the cocking piece of the firearm by means of engaged cam surfaces of the bolt and the cocking piece which will permit the rifle to be cocked only by moving the bolt handle in an upwardly and rotational motion without any longitudinal movement of the bolt towards the cocking piece. After the firearm has been loaded by means of depositing a disc element with a primer element in the center bore thereof in the breech opening of the firearm, the firearm is placed in a firing condition by reversing rotational motion of the bolt handle.

The disc element has a center bore which is adapted to receive a conventional nipple and a percussion cap, or in lieu thereof, and preferably, a shot gun primer. The latter is preferred in that it provides a hotter and more intense ignition of the gun powder in the muzzleloading rifle art. The hotter and speed of ignition of the shotgun primer improves the fire power, velocity, and accuracy of the muzzleloading rifle. A tab on the disc extends out of the breech and facilitates handling of the disc, and provides a visual indicator to the user that the rifle is loaded.

The method of this invention involves the steps of cocking the firearm and loading the firearm with the disc elements as described heretofore.

BRIEF DESCRIPTION OF THE DRAWINGS

FIG. 9 is a view similar to that of FIG. 5 with a retaining pin shown in exploded form;

FIG. 10 is an exploded view of all of the components of the bolt assembly;

DESCRIPTION OF THE PREFERRED EMBODIMENT

This invention is an improvement over U.S. Pat. No. 4,700,499 which features a double safety mechanism including a secondary safety comprised of a rotatable knob on the rearward end of the bolt assembly. The details of that safety feature along with the conventional safety associated with the trigger mechanism of the prior patent are not shown in detail here, but the structure and function thereof are hereby incorporated by reference.

Figures 1, 1A, 2:
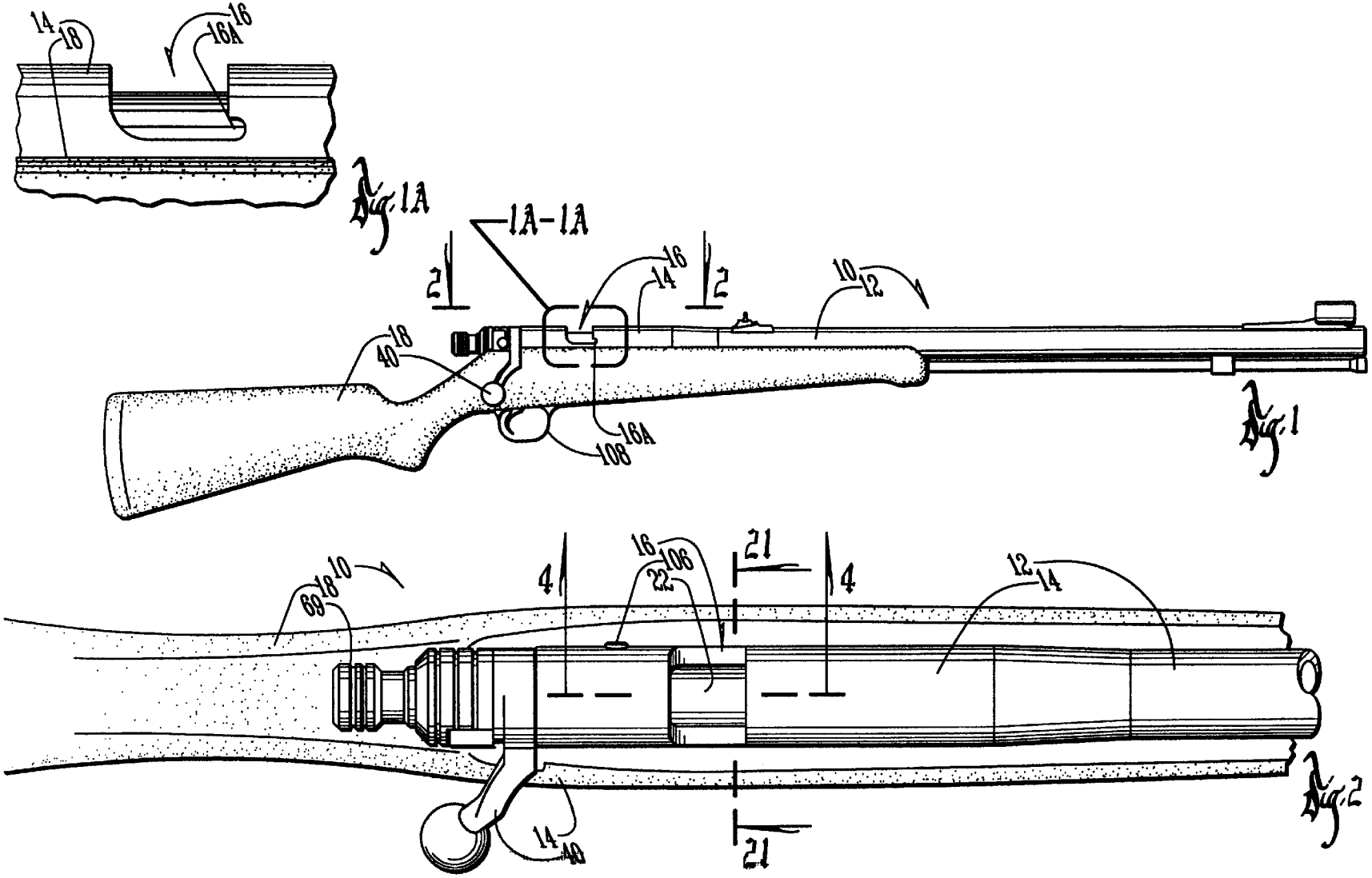
FIG. 1 is a side elevation of the rifle of this invention.
FIG. 1A is an enlarged side elevation of a portion of the rifle of FIG. 1 taken on line 1A—1A of FIG. 1.
FIG. 2 is an enlarged scale plan view of a portion of the rifle of FIG. 1 taken on line 2—2.

The numeral 10 designates the rifle of this invention which includes a conventional barrel 12, a receiver 14, and a breech opening 16 (FIG. 1). As shown in FIG. 1A, the breech opening has a small arcuate gas port 16A which will be discussed more fully hereafter.

Rifle 10 has a conventional gun stock 18 and a breech plug 20 (FIG. 4) which is threadably mounted within the rearward end of barrel 12.

Figures 7, 8:
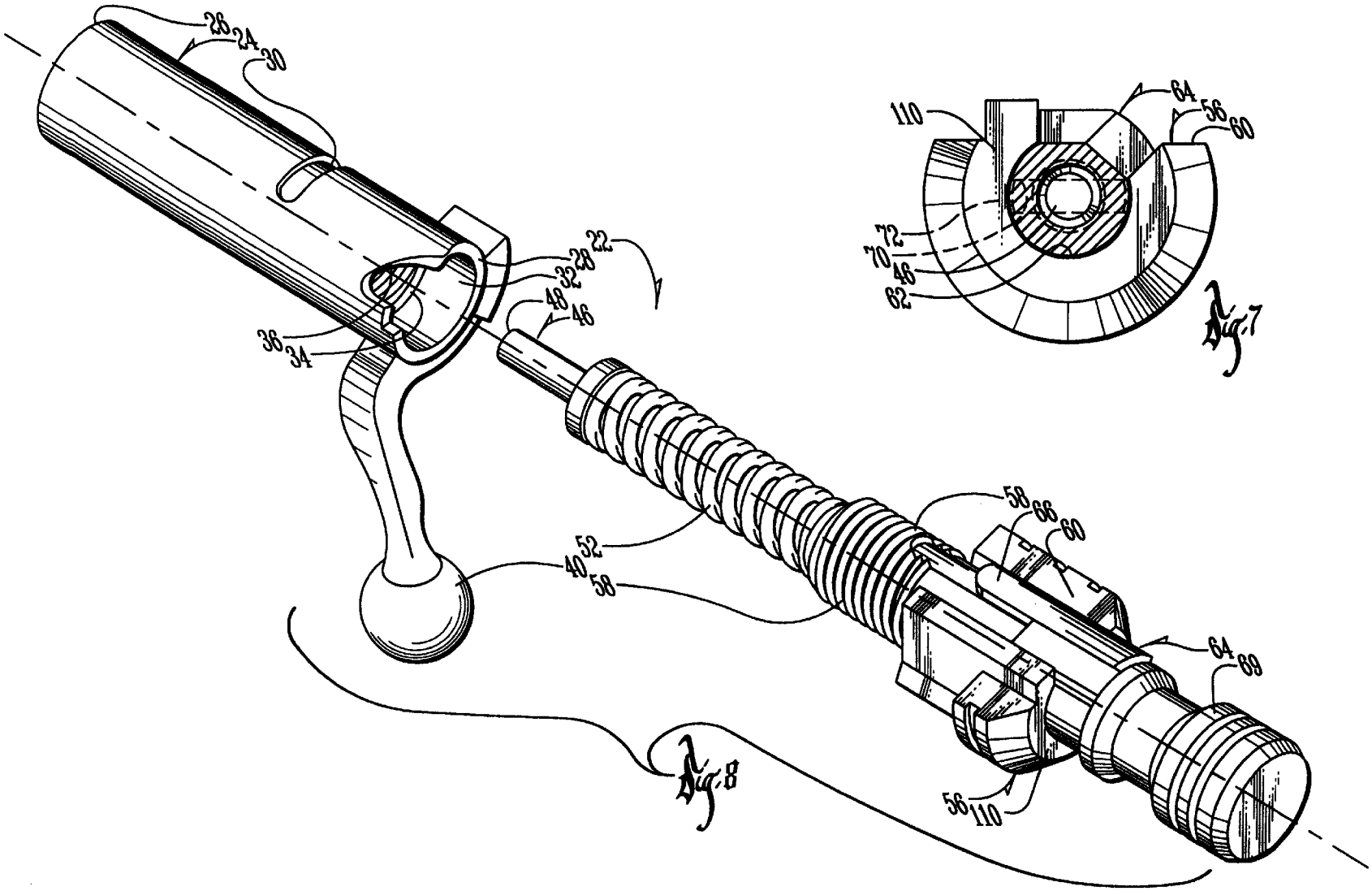
FIG. 7 is an enlarged scale cross sectional view taken on line 7—7 of FIG. 6.
FIG. 8 is an exploded view of the bolt assembly which has been disassembled.
Figure 5:
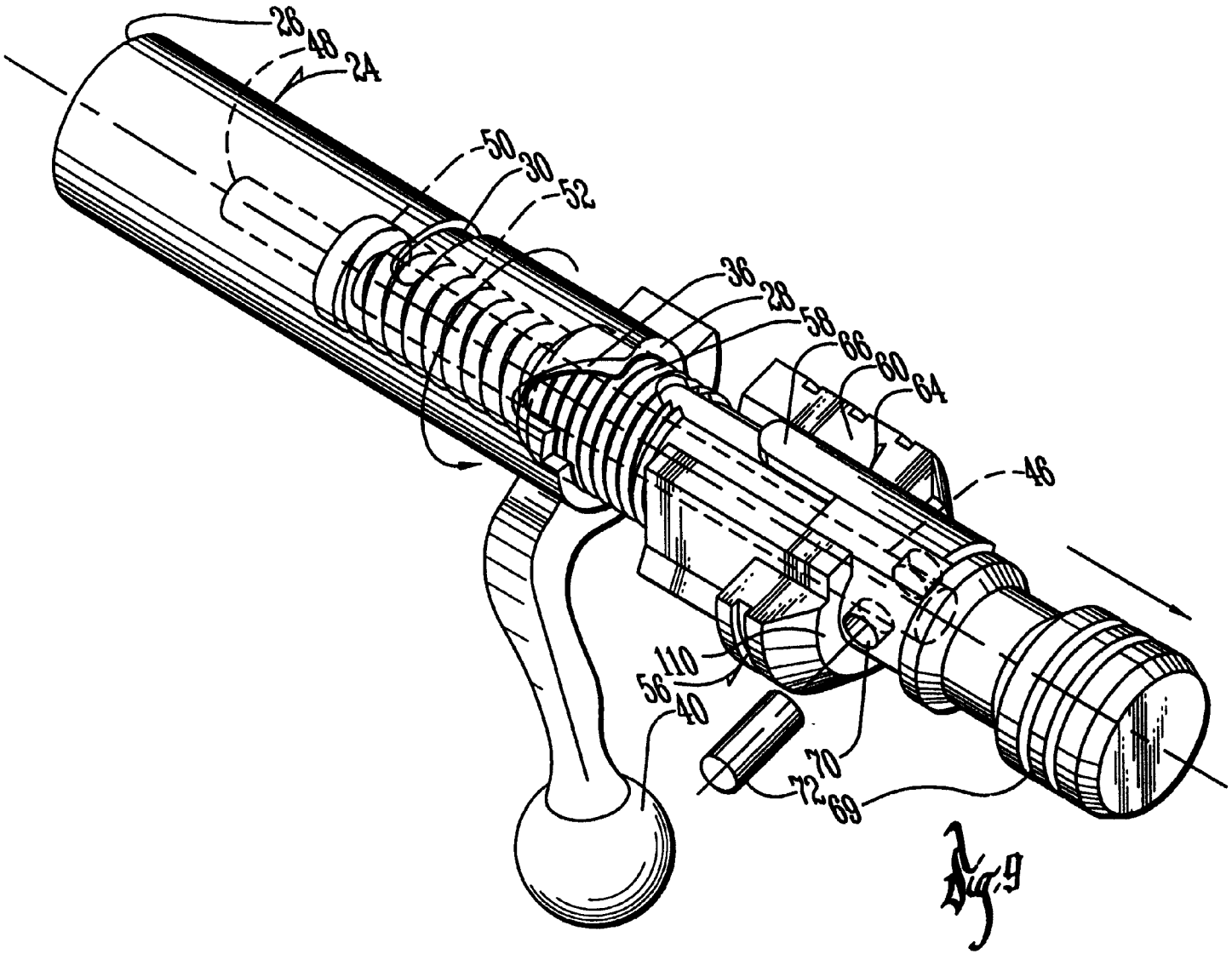

The numeral 22 designates a bolt assembly comprised of a tubular sleeve 24 which has a notch opening 25 in its forward end 26 (FIGS. 21–24). Sleeve 24 has a rearward end 28 (FIG. 8) and an arcuate slot 30 which extends transversely across the sleeve at substantial right angles to the longitudinal axis of the sleeve. However, it should be noted that slot 30 is positioned at a slight angle with respect to the longitudinal axis of the sleeve for a purpose to be described hereafter. Sleeve 24 has a center bore 32 (FIG. 8) and internal threads 34 located adjacent its rearward end 28. A cam notch 36 (FIG. 8) is formed in the rearward end 28 of sleeve 24.

Figure 4:
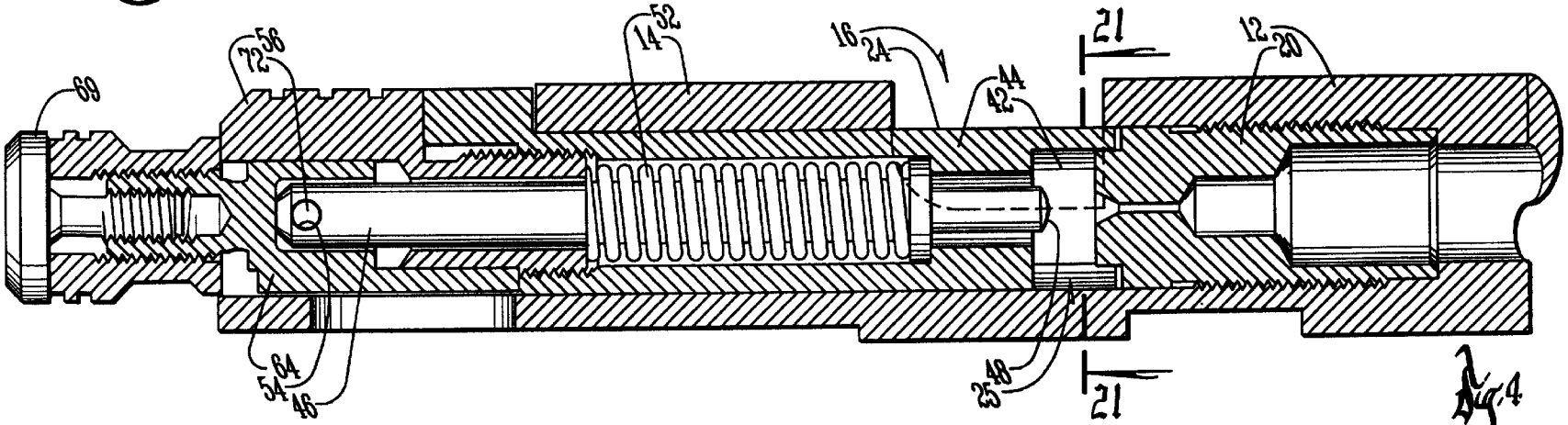
FIG. 4 is an enlarged scale sectional view taken on line 4—4 of FIG. 2 showing the rifle in its uncocked condition.

A disc chamber 42 is located in the forward end of sleeve 24, and notch opening 25 provides the access thereto. As shown in FIG. 4, an internal annular shoulder is formed within the center bore 32 to provide rearward support for the chamber 42, and to provide forward support for the striker pin shaft 46 (FIGS. 4 and 10). As seen in FIG. 4, the forward end 48 of striker pin shaft extends through the bore within shoulder 44, and a shoulder 50 on striker pin shaft 46 bears against the rearward end of shoulder 44. A coil spring 52 extends over striker pin shaft 46 with the forward end thereof bearing against the shoulder 50. Shoulder 50 prevents any blowback from the ignition from contaminating the spring 52. Aperture 54 (FIG. 10) is located in the rearward end of striker pin shaft 46.

As best shown in FIG. 10, an endcap 56 is located rearwardly of sleeve 24 and is threadably secured to the sleeve by the hollow threaded forward end 58 thereof which engages threads 34 which are located in the center bore of sleeve 24. A U-shaped rearward portion 60 of endcap 56 has a smooth bore 62 (FIG. 10).

A cocking piece 64 is best shown in FIG. 10 and has a forwardly extending cam element 66 which is adapted to engage the cam notch 36 at the rearward end of sleeve 24. A rearwardly extending stud 68 is mounted on cocking piece 64. A laterally extending aperture 70 is formed in cocking piece 64 and is adapted to receive pin 72 which extends through aperture 70 in the cocking piece and also extends through the aperture 54 at the rearward end of striker pin 56 (FIG. 10).

With reference to FIGS. 13–20, a disc 24 is comprised of housing 76 which has front face 78, a rear face 80, side portions 82, a top portion 84, and a bottom portion 86. A center bore 88 extends longitudinally through the housing 76.

Figure 20:
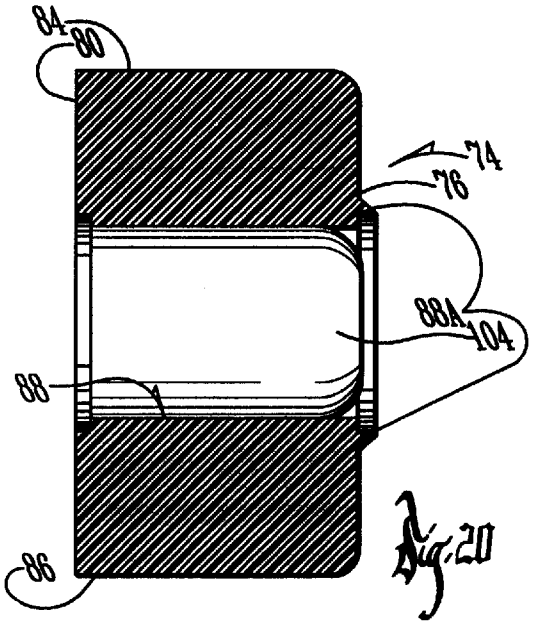
FIG. 20 is a sectional view thereof with a shotgun primer mounted therein.
Figure 19:
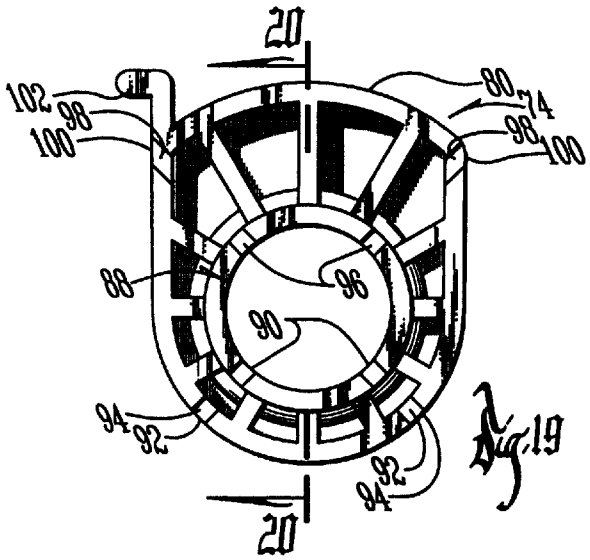
FIG. 19 is a rear elevational view thereof.

The disc is comprised of hard plastic, such as Fortiflex K50-10-136 High Density Polyethylene (HDPE), or the like and has a center bore 88 extending longitudinally and horizontally therethrough. With reference to FIG. 19, inner passages 90 are in communication with the center bore 88 and extend towards outer passages 92 which terminate in external ports 94 located at approximately 5 and 7 o'clock positions with respect to bore 88. Similarly, inner passage 96 and 98 extend upwardly and outwardly from bore 88 towards outer passages 98 which terminate in outer ports 100. As also shown in FIG. 19, an elongated tab member 102 extends upwardly and outwardly from the intersection of the top portion 84 and the right hand side 82 as viewed from the rearward end of the rifle 10. The tab member 102 facilitates handling the disc 74 and provides a visible indicia marker for the user to determine if the rifle is loaded. As shown in FIG. 20, a shotgun primer 104 is mounted within the center bore 88 of disc 74. A thin circular ring 88A surrounds center bore 88 and is adapted to seal the disc 74 against primer 104 to prevent rearward movement of gases upon ignition of the primer and the rifle charge. The rearward end of the primer 104 protrudes slightly rearwardly from the bore 88 and is adapted ultimately to be engaged by the forward end 48 of striker pin 46. Conventionally, shotgun primers have an internal anvil therein, and when the outer rear portion of the primer is struck by a striking pin, the reaction with the anvil ignites the powder within the shotgun primer to ignite the black powder or the like within the muzzleloading rifle. In lieu of the shotgun primer, a conventional nipple and percussion cap can be used. However, the shotgun primer is preferred over the nipple and percussion cap because the shotgun primer contains more powder and creates a more consistent ignition of the black powder of the muzzleloading rifle than does the nipple and percussion cap. As indicated above, the more consistent ignition by the shotgun primer increases the velocity and accuracy of the muzzleloading rifle.

When the shotgun primers 104 are used with the disc 74, the discs are used only once and are disposed of after firing has taken place. However, when the discs 74 are used with conventional nipples and percussion caps, the discs can be reused a plurality of times.

Figure 3:
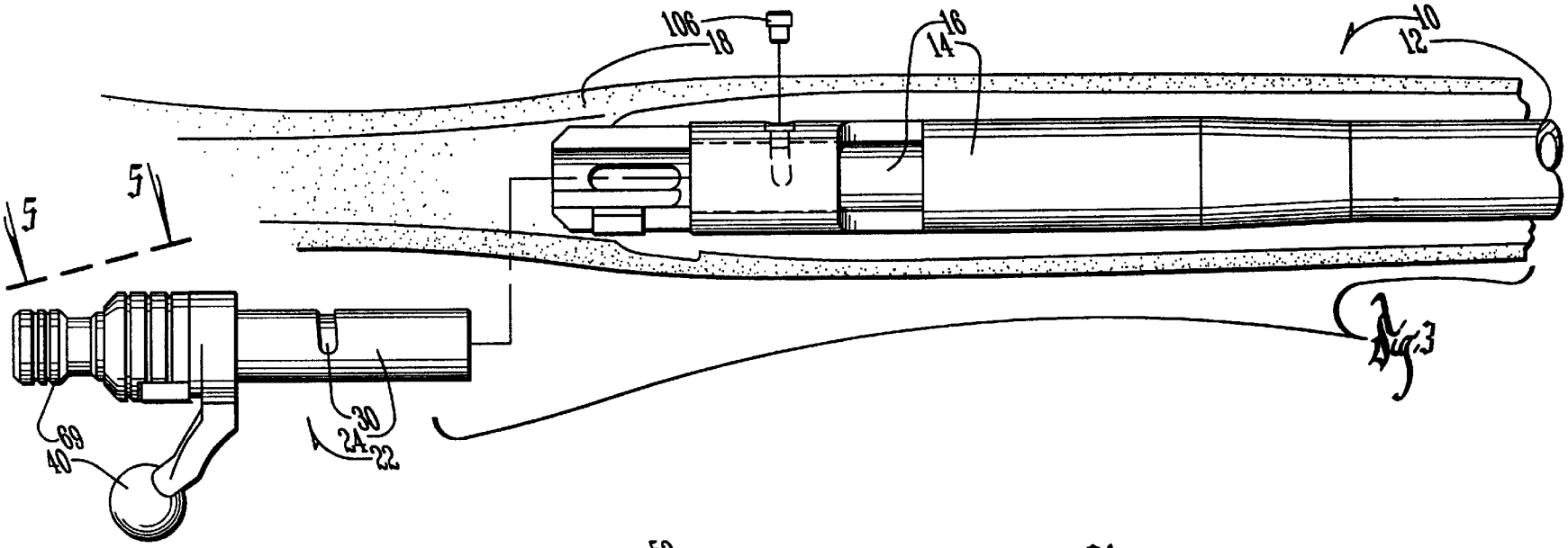
FIG. 3 is a view similar to that of FIG. 2 with the bolt assembly shown as being removed from the receiver.

In operation, the rifle owner will take a plurality of the discs 74 and insert rifle primers 104 therein as described above. These will be carried on the person of the rifle owner and will be used at his or her discretion. When it is desired to fire the rifle 10 or to make it ready for firing, the bolt handle 40 is raised from its lowered position in FIG. 1 to an elevated position at approximately 120° higher than the point of beginning. The set screw 106, (FIG. 3) extends through a suitable aperture in receiver 14 and terminates within the arcuate slot 30 in tubular sleeve 24. Nominal frictional engagement between the set screw and the slot prevent the handle 40 from moving freely in the slot so that it will maintain the upper or lower maximum positions of elevation of the handle without the rifle owner holding the handle in either position.

Figure 6:
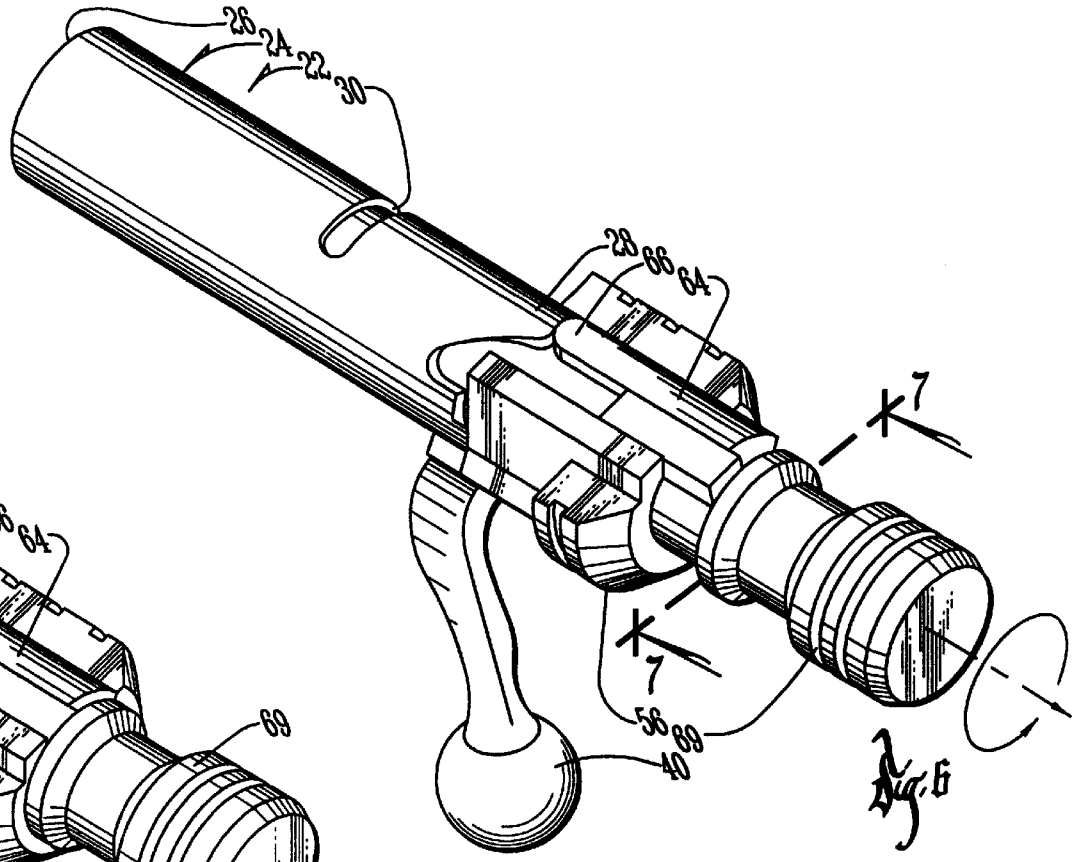
FIG. 6 is a view similar to that of FIG. 5 but shows the bolt assembly in its cocked position.
Figure 5:
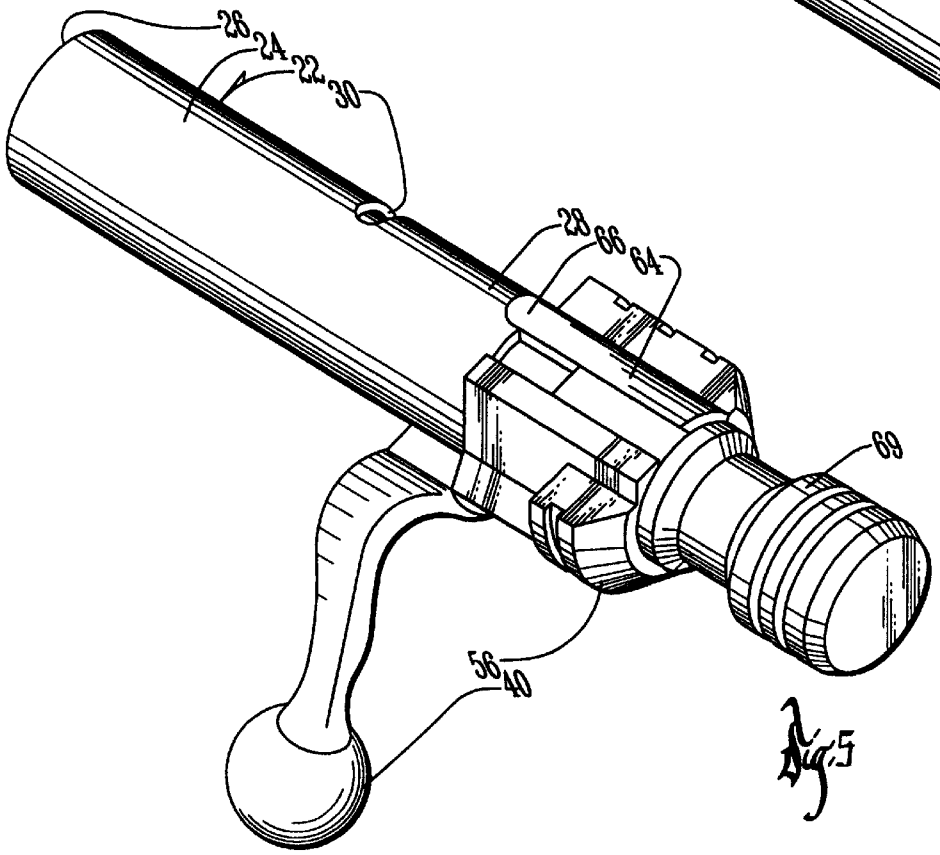
FIG. 5 is a bottom perspective view of the bolt assembly when the striking pin is in the position shown in FIG. 4.
Figure 13:
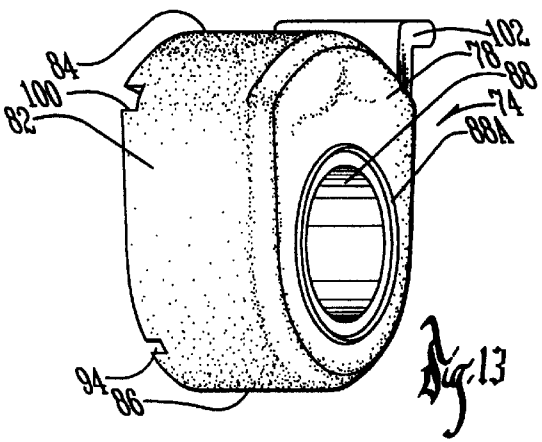
FIG. 13 is a frontal perspective view at an enlarged scale of the disc element of this invention.
Figure 18:
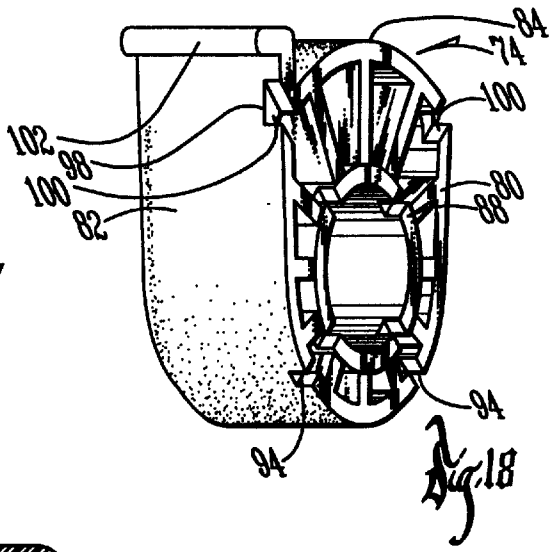
FIG. 18 is a rear perspective view thereof.
Figure 17:
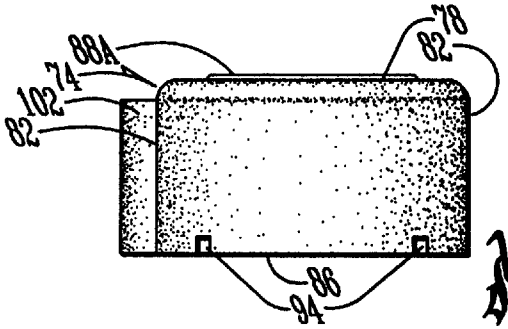
FIG. 17 is a bottom plan view thereof.
Figure 16:
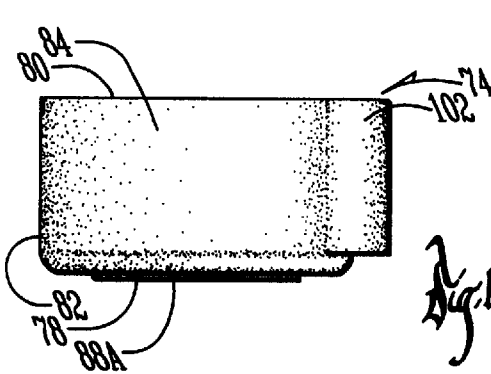
FIG. 16 is a top plan view thereof.

The upper rotation of the bolt handle 40 causes the sleeve 24 to rotate. This causes the cam element 66 on cocking piece 64 to move from a position of engagement within the cam notch 36 on the rearward end of sleeve 24 to a rearward position as shown in FIG. 6. Thus, the rotational motion of the tubular sleeve 24 causes the cocking piece to move rearwardly with respect thereto. By virtue of pin 72 (FIGS. 4 and 10), the cocking piece pulls the striker pin rearwardly and causes the spring 52 to compress as shown in FIG. 13. The sear (not shown) of the conventional trigger assembly 108 (FIG. 1) conventionally engages the cocking piece 64, all in accordance with the teachings of U.S. Pat. No. 4,700,499. This action prevents the cocking piece 64 and the striker pin 46 from moving forwardly until the trigger is pulled. The safety knob 69 can be rotated forwardly on stud 68 to engage the rearward end of cocking piece 64 to prevent the rifle from being fired by preventing the forward movement of either the cocking piece or the striker pin.

Figure 21:
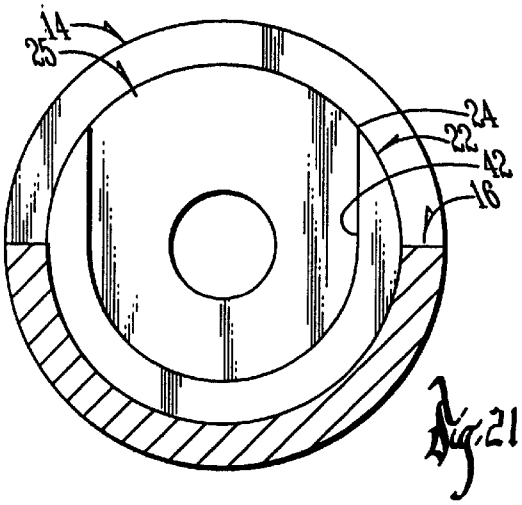
FIG. 21 is an enlarged scale sectional view taken on line 21—21 of FIG. 4.
Figure 22:
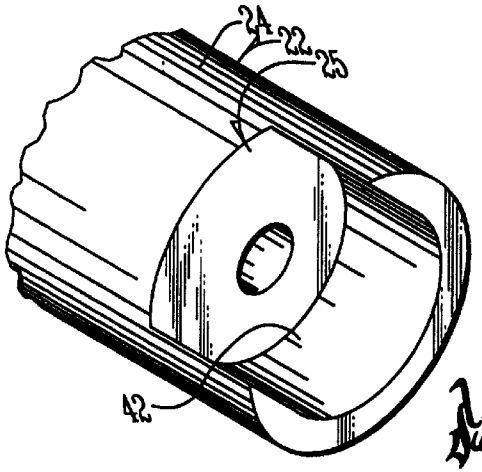
FIG. 22 is a partial perspective view of the forward end of sleeve 24 when the sleeve 24 is in the position of FIG. 21.
Figure 23:
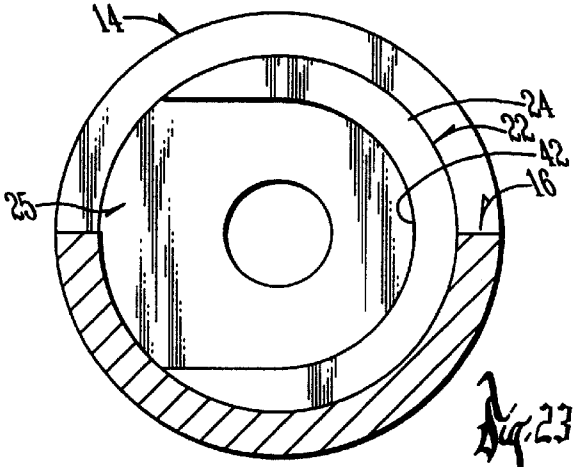
FIG. 23 is an enlarged sectional view similar to that of FIG. 2 but taken on line 21—21 of FIG. 2.
Figure 24:
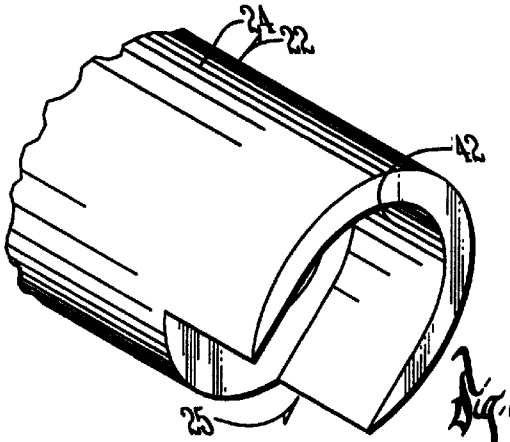
FIG. 24 is a partial perspective view of the forward end of the sleeve 24 when the sleeve 24 is in the position shown in FIG. 23.

When the breech opening 16 open, by virtue of the notch opening 25 in the bolt 24 being moved from the "closed" position of FIGS. 23 and 24 to the "open" position of FIGS. 21 and 22, the rifle owner can deposit a disc 74 with primer 104 therein (FIG. 20) in the chamber 42 at the forward end of the sleeve 24 and the breech opening 16. Preferably, the configuration of chamber 42 will accommodate the shape of the housing 76 of disc 74 so that the disc cannot be placed in the chamber 42 in an incorrect manner or position.

The bolt handle 40 can then be returned to its lower position which causes the sleeve 24 to move from the open position of FIGS. 21 and 22 to the closed position of FIGS. 23 and 24. When this is done, the oblique cam groove 40 in the sleeve 24 through coaction with the set screw or detent 106 causes the sleeve 24 to move slightly forwardly to firmly contact the rearward face 80 of disc 74 to stabilize its position within the chamber 42 so as to more effectively prevent the escape of gases from the ignition of the primer 104.

Figure 11:
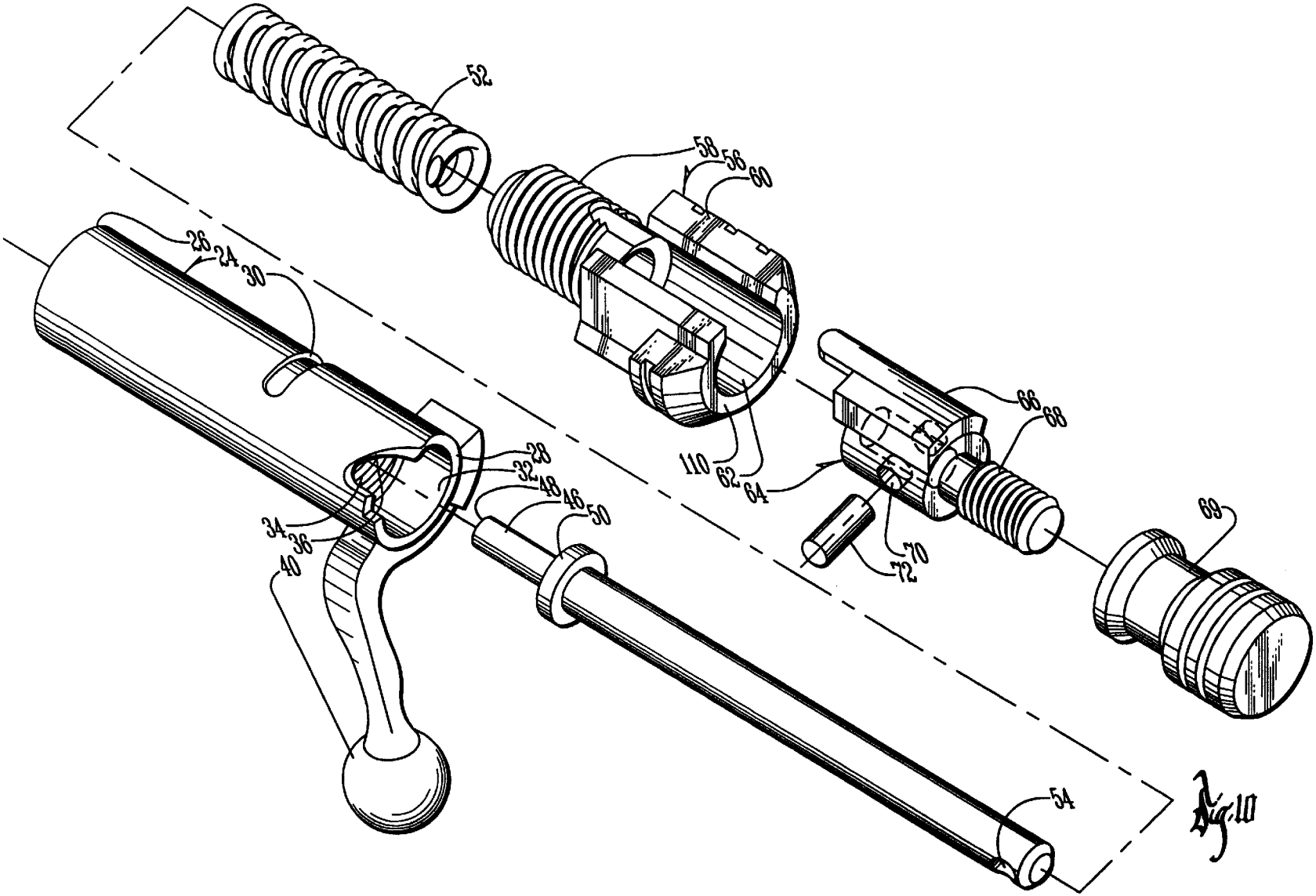
FIG. 11 is an enlarged scale longitudinal sectional view of the breech opening of the rifle in its cocked condition.
Figure 12:
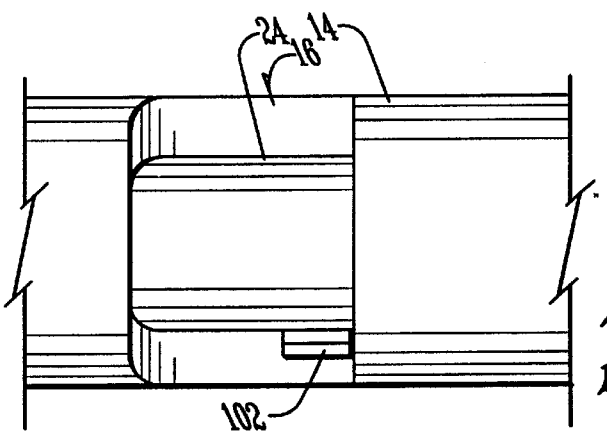
FIG. 12 is a plan view taken from the top of FIG. 11.
Figure 11:
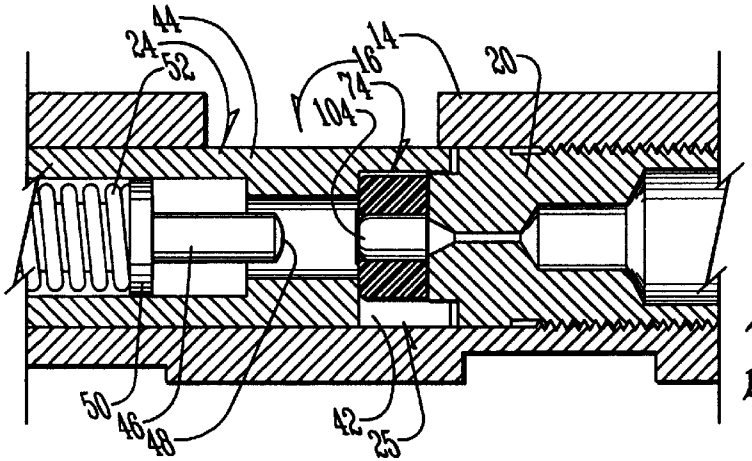
Figure 15:
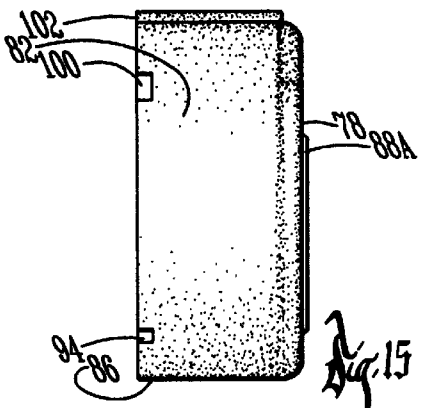
FIG. 15 is a side elevational view thereof as seen from the lefthand side of FIG. 14.
Figure 14:
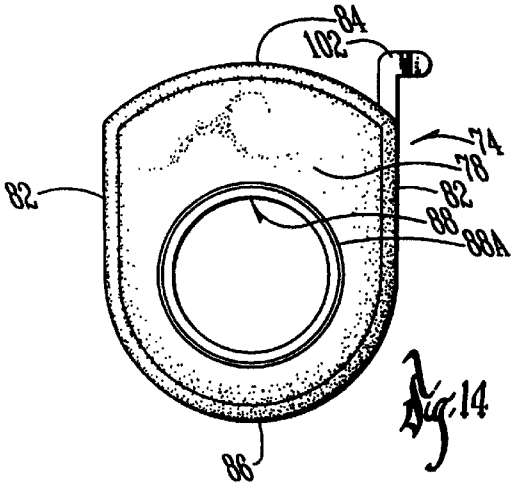
FIG. 14 is a front elevational view of FIG. 13.

When the safety knob 69 is loosened with respect to the cocking piece 64, and when the primary safety (not shown) on the rifle is released, the rifle is ready for firing. When the trigger is pulled and the trigger sear (not shown) releases the cocking piece 69, the spring 52 expands and forces the striker pin forwardly from the position of FIG. 11 to the position of FIG. 4. This causes the forward end 48 of the striker pin to forcibly engage the rearward end of the primer 104, thus igniting the primer and causing the primer to ignite the black powder conventionally located in the muzzleloading rifle.

The passages 90, 92, 96, and 98, and the ports 94 and 100 in the disc housing 76 are useful in causing ignition gases in bore 88 of the disc to be expelled laterally away from the face of the person firing the rifle. In addition, the gas port 16A in breech opening 16 facilitates the lateral movement of gases in the breech opening to move laterally, again away from the face of the person shooting the rifle.

From the foregoing, it is seen that this invention will achieve at least all of its stated objectives.

What is claimed is:

1. A firearm, comprising, an elongated barrel having a rearward end, a receiver at the rearward end having a breech opening in alignment with said barrel for receiving a rifle firing element therein, a bolt having a longitudinal axis rotatably mounted on said firearm rearwardly of said breech opening, a spring loaded striker pin in said bolt, a cocking piece on said rifle in operational engagement with said striker pin, a trigger assembly on said rifle in operational engagement with said cocking piece, a handle on said bolt to partially rotate said bolt about its longitudinal axis, and cam surfaces on said bolt and said cocking piece in engagement with each other and being shaped so that rotation of said bolt from a first rotational position about its longitudinal axis to a second rotational position only through rotational force applied to said handle will cock said cocking piece to move said striker pin into a firing position.

2. A firearm, comprising, an elongated barrel having a rearward end, a receiver at the rearward end having a breech opening in alignment with said barrel for receiving a rifle firing element thereof, a bolt having a longitudinal axis rotatably mounted on said firearm rearwardly of said breech opening, a spring loaded striker pin in said bolt, a cocking piece on said rifle in operational engagement with said striker pin, a trigger assembly on said rifle in operational engagement with said cocking piece, a handle on said bolt to partially rotate said bolt about its longitudinal axis, and cam surfaces on said bolt and said cocking piece in engagement with each other and being shaped so that only rotation of said bolt from a first rotational position about its longitudinal axis to a second rotational position will cock said cocking piece to move said striker pin into a firing position.

3. A firearm, comprising, an elongated barrel having a rearward end, a receiver at the rearward end having a breech opening in alignment with said barrel for receiving a rifle firing element therein, a bolt having a longitudinal axis rotatably mounted on said firearm rearwardly of said breech opening, a spring loaded striker pin in said bolt, a cocking piece on said rifle in operational engagement with said striker pin, cam surfaces on said bolt and said cocking piece in engagement with each other and being shaped so that only rotation of said bolt from a first rotational position about its longitudinal axis to a second rotational position will cock said cocking piece to move said striker pin into a firing position.

4. The firearm of claim 1 wherein a restraining element on said rifle frictionally engages said bolt to releasably engage said bolt to releasably restrain said bolt from rotational motion.

5. The firearm of claim 2 wherein a restraining element on said rifle frictionally engages said bolt to releasably engage said bolt to releasably restrain said bolt from rotational motion.

6. The firearm of claim 3 wherein a restraining element on said rifle frictionally engages said bolt to releasably engage said bolt to releasably restrain said bolt from rotational motion.

7. The firearm of claim 1 wherein a restraining element on said rifle frictionally engages said bolt to releasably engage said bolt to releasably restrain said bolt from rotational motion.

8. The firearm of claim 1 wherein said firing element is a removable disc element mounted in a breech opening in said receiver and having a central bore in alignment with a center axis of said barrel, and a primer element in said bore in alignment with a forward end of said striker pin to be forcibly engaged thereby upon said rifle being fired.

9. The firearm of claim 2 wherein said firing element is a removable disc element mounted in a breech opening in said receiver and having a central bore in alignment with a center axis of said barrel, and a primer element in said bore in alignment with a forward end of said striker pin to be forcibly engaged thereby upon said rifle being fired.

10. The firearm of claim 3 wherein said firing element is a removable disc element mounted in a breech opening in said receiver and having a central bore in alignment with a center axis of said barrel, and a primer element in said bore in alignment with a forward end of said striker pin to be forcibly engaged thereby upon said rifle being fired.

11. The firearm of claim 1 wherein a removable disc element is mounted in a breech opening in said receiver and having a central bore in alignment with a center axis of said barrel, and a primer element in said bore in alignment with a forward end of said striker pin to be forcibly engaged thereby upon said rifle being fired.

12. A firearm, comprising, an elongated barrel having a rearward end, a receiver at the rearward end having a breech opening in alignment with said barrel for receiving a rifle firing element therein, a bolt having a longitudinal axis rotatably mounted on said firearm rearwardly of said breech opening, a spring loaded striker pin in said bolt, a disc element having a center bore removably mounted in said breech opening in said receiver and a primer element in said bore in alignment with a forward end of said striker pin to be forcibly engaged thereby upon said rifle being fired.

13. The firearm of claim 12 wherein said disc element has a tab that extends laterally out of said breech opening to visibly reveal the presence of said disc in said breech opening to indicate that the firearm is loaded.

14. The firearm of claim 12 wherein said disc has laterally extending passageways extending outwardly from said central bore to an exit port to direct gases from said breech opening resulting from the firing of said firearm in a lateral direction.

15. The firearm of claim 12 wherein said breech opening has port extending laterally therefrom to direct gases from said breech opening resulting from the firing of said firearm in a lateral direction.

16. The firearm of claim 11 wherein a cam assembly connects said receiver and said bolt so that when said bolt is rotated to cock said cocking piece, said bolt is cammed longitudinally forwardly a small increment of distance to tightly compress said disc element tightly against a forward vertical surface in said breech opening.

17. The firearm of claim 1 wherein said firearm is a muzzleloading rifle.

18. The firearm of claim 2 wherein said firearm is a muzzleloading rifle.

19. The firearm of claim 3 wherein said firearm is a muzzleloading rifle.

20. The firearm of claim 1 wherein said firearm is a muzzleloading rifle.

* * * * *